US009873601B2

(12) United States Patent
Oxley

(10) Patent No.: US 9,873,601 B2
(45) Date of Patent: Jan. 23, 2018

(54) HYBRID FORKLIFT TRUCK

(71) Applicant: Clark Material Handling Company, Lexington, KY (US)

(72) Inventor: Lonnie R. Oxley, Versailles, KY (US)

(73) Assignee: CLARK MATERIAL HANDLING COMPANY, Lexington, KY (US)

( * ) Notice: Subject to any disclaimer, the term of this patent is extended or adjusted under 35 U.S.C. 154(b) by 527 days.

(21) Appl. No.: 14/534,953

(22) Filed: Nov. 6, 2014

(65) Prior Publication Data

US 2015/0122584 A1 May 7, 2015

Related U.S. Application Data

(60) Provisional application No. 61/900,456, filed on Nov. 6, 2013.

(51) Int. Cl.
*B66F 9/075* (2006.01)

(52) U.S. Cl.
CPC ..... *B66F 9/07572* (2013.01); *Y10S 903/903* (2013.01)

(58) Field of Classification Search
CPC ..... B60K 31/00; B60K 11/06; B60K 1/04; B60K 6/46; B60K 6/48; B66F 9/07572
See application file for complete search history.

(56) References Cited

U.S. PATENT DOCUMENTS

| | | | | |
|---|---|---|---|---|
| 4,815,550 | A * | 3/1989 | Mather | B60K 11/00 123/41.49 |
| 8,126,618 | B2 * | 2/2012 | Yamada | B60K 28/04 180/273 |
| 8,165,738 | B2 * | 4/2012 | Akaki | B60K 6/48 180/53.1 |
| 8,370,015 | B2 * | 2/2013 | Kato | B60K 6/46 701/22 |
| 8,718,843 | B2 * | 5/2014 | Kubota | B60L 1/20 701/22 |
| 8,960,346 | B2 * | 2/2015 | Ogawa | B60K 11/06 180/68.1 |
| 9,533,573 | B2 * | 1/2017 | Chae | B60K 31/00 |
| 2008/0060860 | A1 * | 3/2008 | Murase | B60K 1/04 180/65.31 |
| 2011/0052433 | A1 * | 3/2011 | Huang | F04D 19/007 417/423.5 |

* cited by examiner

*Primary Examiner* — Hau V Phan
(74) *Attorney, Agent, or Firm* — King & Schickli, PLLC

(57) ABSTRACT

A hybrid forklift truck includes a truck assembly having a lift section, a drive section and a power supply compartment. A power module is received in the power supply compartment. The power module includes an energy storage compartment, a generator compartment, a fuel tank compartment and an energy storage device received in the energy storage compartment. A DC electric generator and cooperating internal combustion engine are received in the generator compartment. Further, the control system is provided for operating a forklift truck including the lift section and the drive section.

25 Claims, 3 Drawing Sheets

HYBRID FORKLIFT TRUCK

This application claims the benefit in priority to U.S. Provisional Patent Application Ser. No. 61/900,456 filed on Nov. 6, 2013, the full disclosure of which is incorporated herein by reference.

TECHNICAL FIELD

This document relates generally to the forklift truck field and, more particularly, to a new hybrid forklift truck.

BACKGROUND

In the past, forklift trucks have generally been designed to operate on either battery power or fossil fuel sources. No commercially viable hybrid forklift truck has been developed to date.

This document relates to a commercially viable forklift truck incorporating a hybrid power module and related control system. These work together to allow the truck to be effectively and efficiently powered by both stored electrical energy as well as energy generated from the combustion of fossil fuel sources.

SUMMARY

In accordance with the purposes and benefits described herein, a hybrid forklift truck is provided. That truck comprises a truck assembly including a lift section, a drive section and a power supply compartment. A power module is received in the power supply compartment. The power module includes an energy storage compartment, a generator compartment, a fuel tank compartment and an energy storage device received in the energy storage compartment. Further, a DC electric generator and a cooperating internal combustion engine are received in the generator compartment. In addition a control system is provided for operating the forklift truck including the lift section and the drive section.

In one possible embodiment the truck includes a front and a rear and the power module is positioned in the power supply compartment with the generator compartment toward the front and the energy storage compartment toward the rear. In one possible embodiment, the energy storage device is a multiple cell battery and the internal combustion engine includes an electric starter. The electric starter is powered by selected cells of the multiple cell battery.

In one possible embodiment, a grating is provided between the generator compartment and the fuel tank compartment. Further, the power module includes a sidewall having a cutdown profile at the fuel tank compartment and an opening at the generator compartment.

In one possible embodiment, a lift hood is provided for additional access to the fuel tank compartment. In one possible embodiment, the internal combustion engine includes a radiator mounted to the sidewall over the opening and an air pathway is provided for cooling the internal combustion engine. The air pathway extends from the cutdown profile of the sidewall through the grating across the internal combustion engine, through the radiator and then through the sidewall opening. In one possible embodiment, a cooling fan is positioned between the internal combustion engine and the grating. In one possible embodiment, that cooling fan is positioned adjacent the radiator.

In one possible embodiment, the internal combustion engine includes an in-line engine block, an air filter system and an exhaust system wherein the internal combustion engine maintains a narrow horizontal profile from front to rear of the truck by vertical stacking of the filter system and exhaust system above or below the inline engine block.

In one possible embodiment, the generator includes electric power output terminals that are located along a top or bottom surface of the generator within a side profile of the generator so as to minimize the horizontal dimension of the generator from front to rear of the truck. Further, the internal combustion engine does not include a dedicated engine alternator so as to accommodate a smaller horizontal profile. Still further, in one possible embodiment the internal combustion engine also does not include a dedicated battery for engine starting. This also minimizes space requirements and helps to maintain a smaller horizontal profile.

In one possible embodiment, the truck accessories are powered by the main generator.

In one possible embodiment, a removable fuel tank is provided. That fuel tank may be easily inserted into and removed from the power module through the cutdown profile of the sidewall.

In one possible embodiment, a cover is provided over the generator compartment. Further, in one possible embodiment a divider is provided between the energy storage compartment and the generator compartment. The cover engages or nearly contacts this divider, the grating and the sidewall of the power module. In one possible embodiment, sound insulation is provided on the cover.

In one possible embodiment, the lift section includes a lift section drive motor, a telescoping mast assembly that may be raised and lowered and a displaceable carriage assembly carried on that mast assembly.

In one possible embodiment, the truck further includes a dynamic charging circuit wherein the energy storage device is charged by the lift motor whenever the mast assembly is lowered. In one possible embodiment, the dynamic charging circuit also charges the energy storage device whenever the carriage assembly is lowered on the mast assembly.

In one possible embodiment, the lift section includes a lift section drive motor and a lift controller. The drive section includes a traction motor and a traction controller. Further the control system includes a DC power bus connected to the energy storage device and the generator.

In one possible embodiment, the truck further includes offset lifting eyes aligned with the center of gravity of the power module to maintain level position lifting.

In the following description, there are shown and described several preferred embodiments of the hybrid forklift truck. As it should be realized, the truck is capable of other, different embodiments and its several details are capable of modification in various, obvious aspects all without departing from the truck as set forth and described in the following claims. Accordingly, the drawings and description should be regarded as illustrative in nature and not as restrictive.

BRIEF DESCRIPTION OF THE DRAWINGS

The accompanying drawings incorporated herein and forming a part of the specification, illustrate several aspects of the hybrid forklift truck and together with the description serve to explain certain principles thereof. In the drawings.

Reference will now be made in detail to the present preferred embodiment of the hybrid forklift truck illustrated in the accompanying drawings.

DETAILED DESCRIPTION

Figure 1:
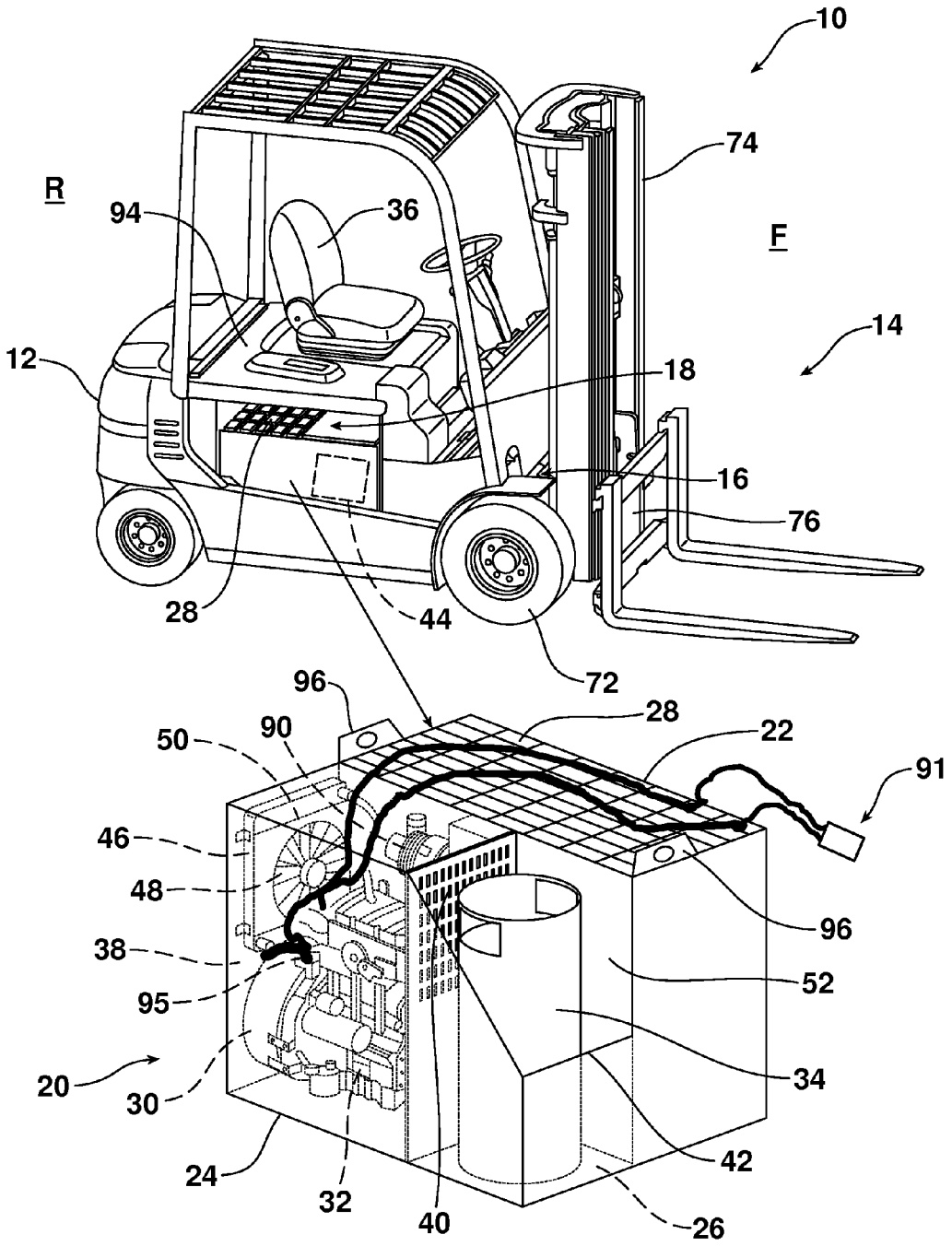
FIG. 1 a perspective view of the hybrid forklift truck.

Reference is now made to FIG. 1 illustrating a hybrid forklift truck 10 including a truck assembly 12 comprising a body and frame, a lift section generally designated by reference numeral 14, a drive section generally designated by reference numeral 16 (and hidden under the body) and a power supply compartment 18. A power module 20 is received in the power supply compartment 18.

The power module 20 includes an energy storage compartment 22, a generator compartment 24, a fuel tank compartment 26 and an energy storage device 28 received in the energy storage compartment 22. In the illustrated embodiment the energy storage device 28 is a multiple cell battery. It should be appreciated, however, that the energy storage device may comprise a capacitor system, a combination multiple cell battery and capacitor system or any other device suitable for storing electric energy as required to operate the hybrid forklift truck 10.

A DC electric generator 30 and a cooperating internal combustion engine 32 are received in the generator compartment 24. The internal combustion engine 32 may include an enlarged oil sump in order to allow for a longer service interval. A removable or replaceable fuel tank such as an LP gas tank 34 is received in the fuel tank compartment 26.

As illustrated in FIG. 1, the truck 10 includes a front F and a rear R. The power module 20 is positioned in the power supply compartment 18 beneath the seat 36 with the generator compartment 24 oriented toward the front F and the energy storage compartment 22 oriented toward the rear R. The multiple cell battery 28 in the energy storage compartment weighs significantly more than the electric generator 30 and the internal combustion engine 32 in the generator compartment 24. The power module 20 is oriented in this manner to place that greater weight to the rear R of the truck 10 where it may provide greater counterbalance to any load being lifted by the lift section 14. Additional counterbalance weights may be provided in any available space in the generator compartment 24.

Lifting eyes 96 are provided for lifting and handling the power module 20 by means of a lift or overhead crane and cooperating lift device such as a lift bar. As should be appreciated, the lift eyes 96 are offset toward the heavier, energy storage compartment 22 side of the power module 20 so as to be aligned with the center of gravity and maintain the module level during lifting.

As further illustrated in FIG. 1, a grating 40 is provided between the generator compartment 24 and the fuel tank compartment 26. Further, the sidewall of the power module housing 22 has a cutdown profile 42 at the fuel tank compartment 26 and an opening 44 at the generator compartment 24. The radiator 46 of the internal combustion engine 32 is mounted to the power module housing sidewall 38 over the opening 44. An air pathway for cooling the internal combustion engine 32 extends from the cutdown profile 42 through the grating 40 across the internal combustion engine, through the radiator 46 and then through the sidewall opening 44. As illustrated in FIG. 1, an electric powered cooling fan 48 is positioned adjacent the radiator 46 to draw cooling air through the air pathway. In an alternative embodiment, a belt driven engine-powered cooling fan 48 may be positioned between the internal combustion engine 32 and the grating 40. In one possible embodiment, the energy storage device or battery 28 is integral to the housing 22 and divider 52.

In one possible embodiment, the internal combustion engine 32 is an inline engine block. In one possible embodiment, the filter system 90 and exhaust system of the internal combustion engine 32 is vertically stacked above or below the inline engine block in order to maintain a narrow horizontal profile from the front F to the rear R of the truck 10. Further, the electric power outlet terminals 95 on the generator 30 are located along a top or bottom surface of the generator at a side profile of the generator so as to minimize the horizontal dimension of the generator from the front F to the rear R of the truck 10.

In accordance with additional aspects, the internal combustion engine 32 does not include an alternator. This is done to reduce the width and cost of the internal combustion engine 32. Starting power for the electric starter 100 of the internal combustion engine 32 is provided by selected cells 99 of the multiple cell battery 28 that are compatible with the engine starter voltage. For example, the energy source may include six cells of the forty 2 volt cells of the energy storage device 28 arranged in series to power the twelve volt components such as the starter 100. Charge power for the starter 100 and engine accessories may be provided via the main generator 30 via use of this selected cell method. A voltage step down converter (not shown) could also be applied to supply power for this purpose.

In accordance with still further aspects, it should be appreciated that the cutdown profile 42 of the power module housing 38 at the fuel tank compartment 26 allows one to easily insert or remove an exchangeable LP fuel tank 34 from the power module when refueling the internal combustion engine 32. In alternative embodiments, such as for gasoline and diesel fuel powered internal combustion engines 32, the fuel tank 34 could be of the permanently mounted variety. Further, a cover 50 may be secured over the generator compartment 24. The cover 50 may engage a divider 52 provided between the energy storage compartment 22 and the generator compartment 24. The cover 50 engages the divider 52, the grating 40 and the sidewall of the power module housing 38. Sound insulation may be provided on the cover or elsewhere in the compartment if desired to further control or reduce noise produced by the internal combustion engine 32 and other components in the chamber 24. A connector 91 may be provided to connect the power module 20 to the D.C. bus 66 on the forklift chassis (see FIG. 2).

Figure 2:
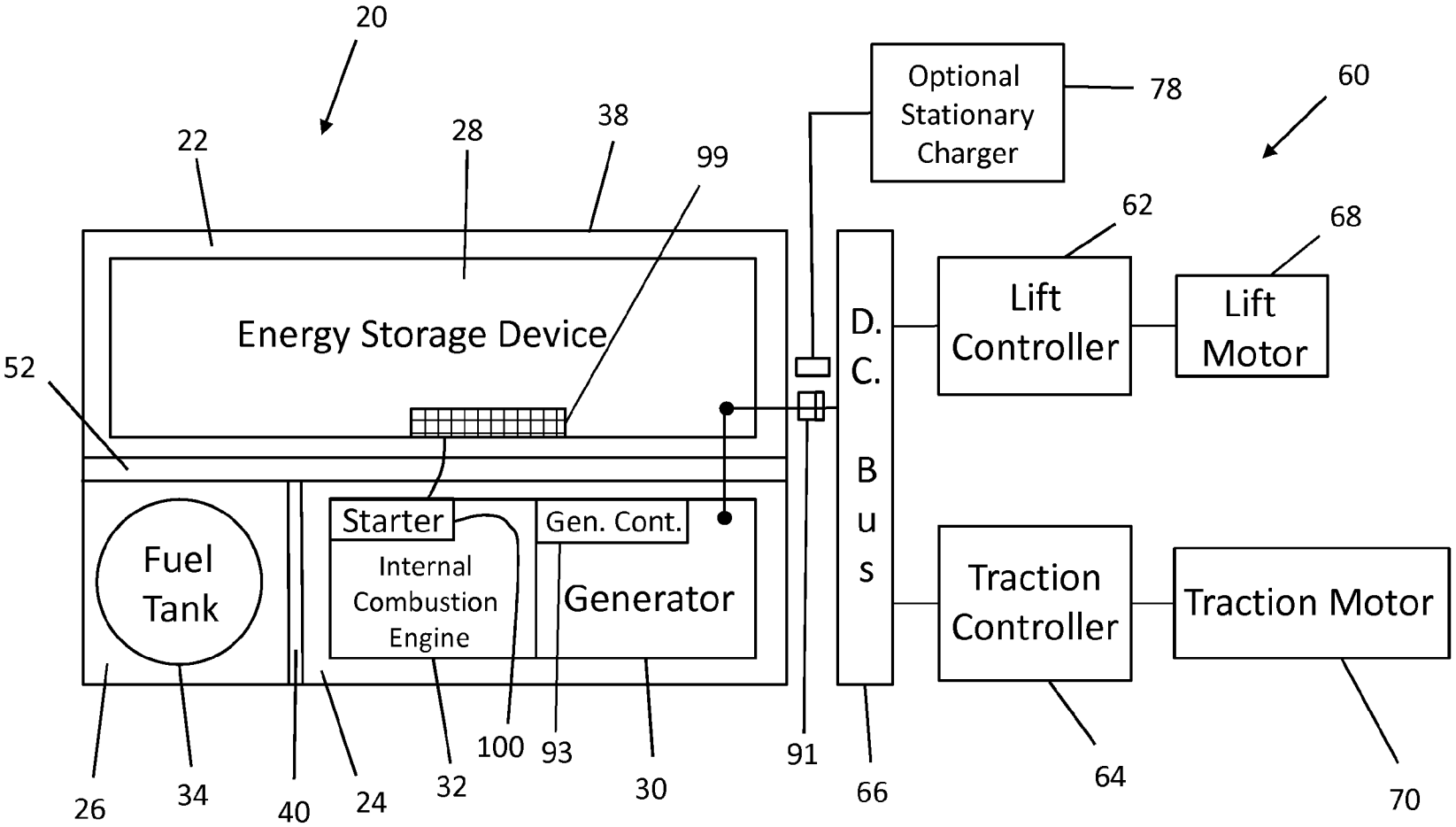
FIG. 2 is a schematical block diagram of the hybrid forklift truck control system.

Reference is now made to FIG. 2 schematically illustrating the control system 60 for operating the forklift truck 10 including the lift section 14 and drive section 16. The control system 60 includes a lift controller 62, a traction controller 64 and a DC bus 66. The energy storage device 28 and generator 30 are connected to the DC power bus 66. During vehicle operation, power is supplied from the energy storage device 28 only, or DC electric generator 30 or both to the DC bus 66. That power is then regulated by the controllers 62, 64 to either the lift motor 68 for driving the hydraulic pumps of the lift section 14 or the traction motor 70 for moving the lift truck 10 on the wheels 72. At times power is drawn only from the energy storage device 28. At still other times power is drawn from both the energy storage device 28 and the generator 30. At times some or all of the electrical energy produced by the generator 30 is routed along the DC bus 66 and used to charge the energy storage device 28. The generator controller 93 insures that power is supplied to the system when needed.

As should be appreciated, the lift section 14 includes a telescoping mast assembly 74 that may be raised and lowered and a displaceable carriage assembly 76 that is carried upon and may be raised and lowered on that mast assembly. In one embodiment the control system 60 includes an optional utility powered stationary charger 78 that functions to charge the energy storage device 28 whenever truck 10 is parked. This is accomplished by manually disconnecting connector 91 from the DC bus 66 and connecting the charger 78 to the battery side of the connector 91.

The truck 10 may also include a dynamic charging provision to provide for charging of the energy storage device 28 via the traction and lift drive circuits, for example, during lowering mode of the mast or carriage assemblies or during braking mode of the traction unit.

Figure 3:
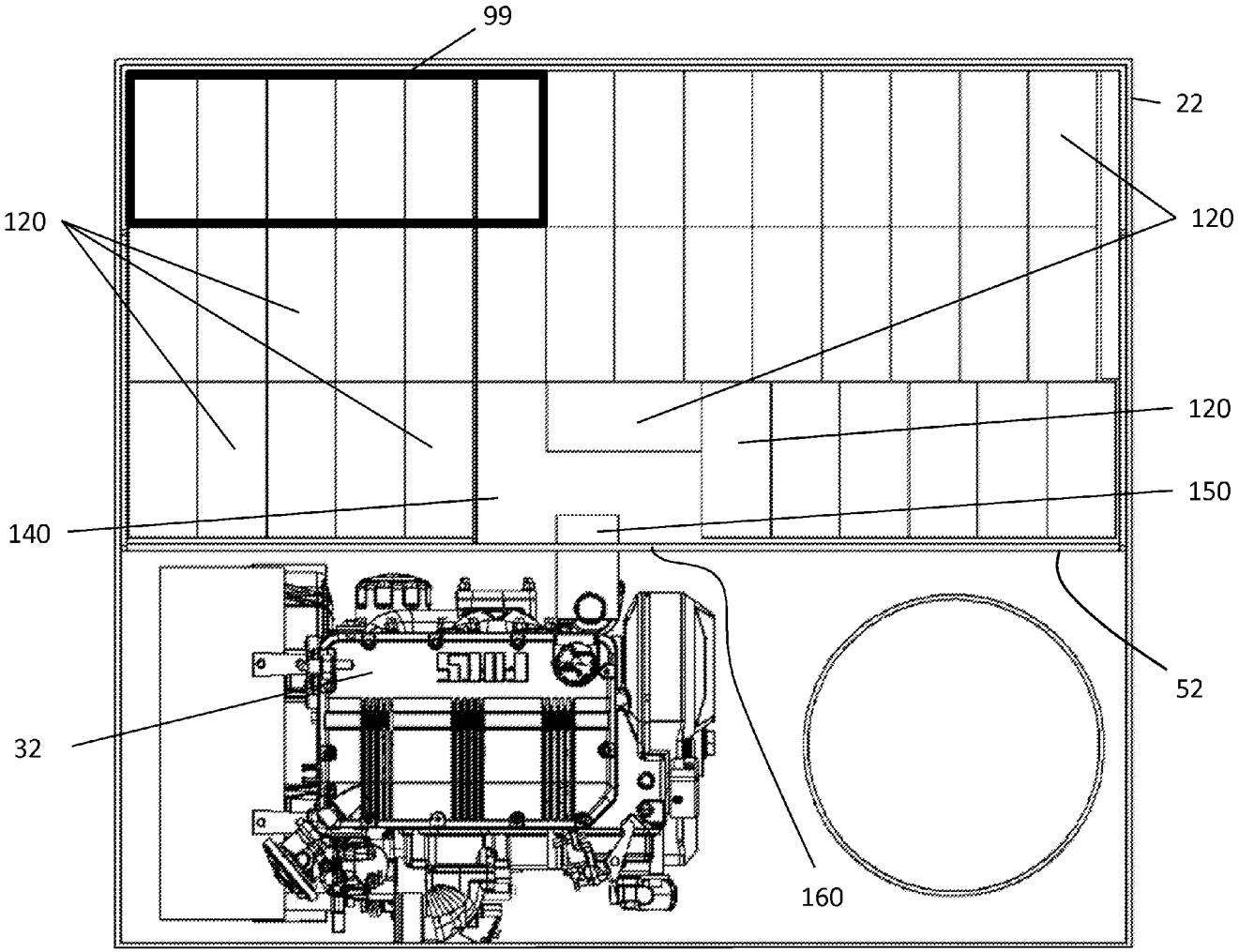
FIG. 3 is a schematic top plan view illustrating how the battery cells in the battery box are arranged to create a clearance space for the generator engine envelope.

The foregoing has been presented for purposes of illustration and description. It is not intended to be exhaustive or to limit the embodiments to the precise form disclosed. Obvious modifications and variations are possible in light of the above teachings. For example, as illustrated in FIG. 3, the battery cells 120 in the energy storage compartment or battery box 22 may be arranged to create a clearance space 140 for the generator engine envelope to protrude into the battery box. Thus, as illustrated in FIG. 3 the injector pump 150 of the internal combustion engine 32 may project through the opening 160 in the sidewall 52 of the battery box 22 into the clearance space 140 between the battery cells 120. The engine hood 94 can also be arranged to open and improve access to remove the exchangeable LP fuel tank 34. Further, the DC electric generator 30 could be replaced with an AC electric generator if desired. All such modifications and variations are within the scope of the appended claims when interpreted in accordance with the breadth to which they are fairly, legally and equitably entitled.

What is claimed:

1. A hybrid forklift truck, comprising:

a truck assembly including a lift section, a drive section and a power supply compartment;

a power module received in said power supply compartment, said power module including an energy storage compartment, a generator compartment, a fuel tank compartment and an energy storage device received in said energy storage compartment;

a DC electric generator and cooperating internal combustion engine received in said generator compartment; and a control system for operating said forklift truck including said lift section and said drive section.

2. The truck of claim 1, wherein said truck includes a front and a rear and wherein said power module is positioned in said power supply compartment with said generator compartment toward said front and said energy storage compartment toward said rear.

3. The truck of claim 1, wherein said energy storage device is a multiple cell battery, said internal combustion engine includes an electric starter and said electric starter is powered by selected cells of said multiple cell battery.

4. The truck of claim 1 further including a grating between said generator compartment and said fuel tank compartment.

5. The truck of claim 4, wherein said power module includes a sidewall having a cutdown profile at said fuel tank compartment and an opening at said generator compartment.

6. The truck of claim 5 further including a lift hood for additional access to said fuel tank compartment.

7. The truck of claim 5, wherein said internal combustion engine includes a radiator mounted to said sidewall over said opening and an air pathway is provided for cooling said internal combustion engine, said air pathway extending from said cutdown profile of said sidewall, through said grating, across said internal combustion engine, through said radiator and then through said sidewall opening.

8. The truck of claim 7 including a cooling fan positioned between said internal combustion engine and said grating.

9. The truck of claim 7 including a cooling fan positioned adjacent said radiator.

10. The truck of claim 5, further including a removable fuel tank wherein said fuel tank may be easily inserted into and removed from said power module through said cutdown profile of said sidewall.

11. The truck of claim 1, including a cover over said generator compartment.

12. The truck of claim 1, wherein said lift section includes a lift section drive motor, a telescoping mast assembly that may be raised and lowered and a displaceable carriage assembly carried on said mast assembly.

13. The truck of claim 12, further including a dynamic charging provision wherein said energy storage device is charged by lift motor whenever said mast assembly is lowered.

14. The truck of claim 12, further including a dynamic charging provision wherein said energy storage device is charged by lift motor whenever said carriage assembly is lowered.

15. The truck of claim 1, wherein said lift section includes a lift section drive motor and lift controller, said drive section includes a traction motor and traction controller and said control system includes a DC power bus connected to said energy storage device and said generator.

16. The truck of claim 1 further including offset lifting eyes aligned with center of gravity of said power module to maintain level position when lifting.

17. A hybrid forklift truck, comprising:

a truck assembly including a lift section, a drive section and a power supply compartment;

a power module received in said power supply compartment, said power module including an energy storage compartment, a generator compartment, a fuel tank compartment and an energy storage device received in said energy storage compartment;

a DC electric generator and cooperating internal combustion engine received in said generator compartment; and a control system for operating said forklift truck including said lift section and said drive section;

said hybrid forklift truck being characterized by said truck including a front and a rear wherein said power module is positioned in said power supply compartment with said generator compartment toward said front and said energy storage compartment toward said rear and wherein said internal combustion engine includes an in-line engine block, an air filter system and an exhaust system and wherein said internal combustion engine maintains a narrow horizontal profile from front to rear of said truck by vertical stacking of said filter system and said exhaust system above or below said in-line engine block.

18. The truck of claim 17, wherein said energy storage device is a multiple cell battery, said internal combustion engine includes an electric starter and said electric starter is powered by selected cells of said multiple cell battery.

19. The truck of claim 18, wherein said starter is vertically stacked over or under said in-line engine block.

20. The truck of claim 19, further including electric power output terminals on said generator, wherein said electric output terminals are located along a top or bottom surface of said generator within a side profile of said generator so as to minimize a horizontal dimension of said generator from front to rear of said truck.

21. The truck of claim 18, wherein said internal combustion engine does not include a dedicated engine alternator so as to accommodate a smaller horizontal profile.

22. The truck of claim 21, wherein said internal combustion engine does not include a dedicated battery for engine starting.

23. The truck of claim 18, wherein selected battery cells powering truck starter and/or lower voltage accessories are charged by said main generator.

24. A hybrid forklift truck, comprising:

a truck assembly including a lift section, a drive section and a power supply compartment;

a power module received in said power supply compartment, said power module including an energy storage compartment, a generator compartment, a cover over said generator compartment, a fuel tank compartment, an energy storage device received in said energy storage compartment and a divider between said energy storage compartment and said generator compartment, said cover engaging said divider, a grating and a sidewall of said power module;

a DC electric generator and cooperating internal combustion engine received in said generator compartment; and a control system for operating said forklift truck including said lift section and said drive section.

25. The truck of claim 24, further including sound insulation on said cover.

* * * * *